US009893460B2

(12) United States Patent
Windgassen et al.

(10) Patent No.: US 9,893,460 B2
(45) Date of Patent: Feb. 13, 2018

(54) UNDERWATER ELECTRICAL CONTACT MATING SYSTEM

(71) Applicants: James Richard Windgassen, Chester, MD (US); Harvey Paul Hack, Arnold, MD (US); Jeffrey Martin Matejka, Oxnard, CA (US)

(72) Inventors: James Richard Windgassen, Chester, MD (US); Harvey Paul Hack, Arnold, MD (US); Jeffrey Martin Matejka, Oxnard, CA (US)

(73) Assignee: Northop Grumman Systems Corporation, Falls Church, VA (US)

( * ) Notice: Subject to any disclaimer, the term of this patent is extended or adjusted under 35 U.S.C. 154(b) by 255 days.

(21) Appl. No.: 14/618,694

(22) Filed: Feb. 10, 2015

(65) Prior Publication Data

US 2016/0233607 A1 Aug. 11, 2016

(51) Int. Cl.

| | |
|---|---|
| ***H01R 13/03*** | (2006.01) |
| ***H01R 24/28*** | (2011.01) |
| ***H01R 13/523*** | (2006.01) |
| *H01R 43/00* | (2006.01) |

(52) U.S. Cl.

CPC ..... *H01R 13/523* (2013.01); *H01R 13/03* (2013.01); *H01R 43/005* (2013.01)

(58) Field of Classification Search

CPC ..... H01R 13/03; H01R 24/28

USPC ..... 439/887, 886, 682, 692

See application file for complete search history.

(56) References Cited

U.S. PATENT DOCUMENTS

| | | | | |
|---|---|---|---|---|
| 6,793,544 | B2 * | 9/2004 | Brady | H01M 8/0206 429/492 |
| 7,911,029 | B2 * | 3/2011 | Cui | H01G 4/206 257/532 |
| 8,262,873 | B2 * | 9/2012 | Wurm | C25D 17/10 204/213 |
| 9,197,006 | B2 * | 11/2015 | Hack | H01R 13/523 |
| 2003/0114026 | A1 * | 6/2003 | Caldwell | H01L 23/49811 439/74 |
| 2004/0043675 | A1 * | 3/2004 | Hiatt | H01L 23/3114 439/894 |
| 2010/0063555 | A1 * | 3/2010 | Janzig | A61N 1/3752 607/2 |
| 2015/0011107 | A1 * | 1/2015 | Hack | H01R 13/523 439/206 |

* cited by examiner

*Primary Examiner* — Gary Paumen
(74) *Attorney, Agent, or Firm* — Tarolli, Sundheim, Covell & Tummino LLP

(57) ABSTRACT

A system includes a first mating component formed from a self-passivating transition metal to supply power. The self-passivating transition metal has a property of forming a non-conductive passivation layer when immersed in water. A second mating component formed from a self-passivating transition metal provides a return path for the power and forms the non-conductive passivation layer when immersed in the water.

19 Claims, 6 Drawing Sheets

UNDERWATER ELECTRICAL CONTACT MATING SYSTEM

TECHNICAL FIELD

This disclosure relates to electrical connectors, and more particularly to a system and method to provide underwater electrical mating connections utilizing self-passivating transition metals.

BACKGROUND

To avoid water contamination of electrical contacts, conventional receptacle and female plug electrical connectors may be sealed by o-rings or gaskets. These designs may work well in generally dry environments however electrical connectors in some applications may be exposed to non-dry air environments, such as humid air, rain, or seawater. Further still, a connector may be submerged in water, for example, ships, submarines, or underwater equipment, for example. Thus, it may be desirable to exclude water from the electrically live portions of the connectors as, among other things, water may create electricity leakage paths. Water can damage the electrically conducting connector contacts by corrosion or by deposition of insulating salts or impurities onto the connectors. In certain applications and environments, it is desirable to not only exclude water after being mated, but also to exclude water during mating—even when mating under water.

Conventional connectors addressing underwater mating or mating in a wet environment may be complex. Such connectors may be filled with oil and may have many small parts, such as dynamic seals and springs, for example. Due, at least in part, to their complexity, conventional connectors may be difficult to build and repair. Such connectors may also be expensive to produce and replace. Dielectric gel containing connectors can also be designed to allow underwater mating of connectors with water exclusion, for example. However, repeated connection and disconnection of these gel-containing connectors may lead to contamination, leakage of the gel, or other problems.

SUMMARY

This disclosure relates to a system and method to provide underwater electrical mating connections utilizing self-passivating transition metals. In one aspect, a system includes a first mating component formed from a self-passivating transition metal to supply power. The self-passivating transition metal has a property of forming a non-conductive passivation layer when immersed in water. A second mating component formed from a self-passivating transition metal provides a return path for the power and prevents a leakage path from forming due to the formation of the non-conductive passivation layer when the power is applied to the first mating component in the water.

In another aspect, a system includes a first mating pin formed from a self-passivating transition metal to supply power. The self-passivating transition metal has a property of forming a non-conductive passivation layer upon immersion in water. A first mating receptor is formed from a self-passivating transition metal to receive power from the first mating pin in the water. A portion of the non-conductive passivation layer is removed upon mating the first mating pin to the first mating receptor. A communication source communicates data across a conductive connection formed by mating the first mating pin and the first mating receptor.

In yet another aspect, an underwater system includes a first mating pin formed from a self-passivating transition metal to supply power. The self-passivating transition metal has a property of forming a non-conductive passivation layer upon immersion in water. A second mating pin is formed from a self-passivating transition metal to provide a return path for the power and to supply a leakage path to form the non-conductive passivation layer when the power is applied to the first mating pin in the water. A first mating receptor is formed from a self-passivating transition metal to receive power from the first mating pin in the water. A portion of the non-conductive passivation layer is removed upon mating of the first mating pin and the first mating receptor to form a conductive connection. A second mating receptor is formed from a self-passivating transition metal to receive the return path for the power from the second mating pin.

DETAILED DESCRIPTION

This disclosure relates to a system to provide underwater electrical mating connections utilizing self-passivating transition metals. A self-insulating underwater electrical connector (SUEC), in one example, is provided for direct current (DC) power transfers and data exchanges (e.g., between devices, systems, a pair of electrical conductors, and so forth). The SUEC includes connector pins and a socket interface configured with mating receptors for accepting the connector pins, or any pair of contacting surfaces including flat plates. The mating receptors and the connector pins can be fabricated out of self-passivating transition metals such as niobium (Nb) or Tantalum (Ta) metal, for example. Due to the electrochemical properties of the transition metals, a passivation layer can be formed when they are exposed to water. Thus, when the mating receptors and/or the connector pins interact with water, a non-conductive passivation layer forms on a surface of the connector pins and/or the receiving ports to provide insulation from the water.

The connector pins can be mated with the mating receptors by positioning (configuring) each connector pin or surface with a respective receptor. The positioning of the connector pins within the mating receptor causes each connector pin to contact a physical port. Since the receptor and the connector pin are fabricated out of transition metals, the physical contact causes a disruption in their respective passivation layers to form a low resistance connection. The low resistance connection provides an electrical connection (electrical medium) through which power and/or data can be exchanged. The connector pin can also be un-mated (disconnected) from the receptor of the SUEC. Disconnecting the connector pin from the receptor exposes the connector pin and the receiving port to the water. This exposure causes the connector pin and the receiving port to re-grow the passivation layer to provide the insulation from the water, and thus, prevent current leakage from the exposed contacts into the water.

Figure 1:
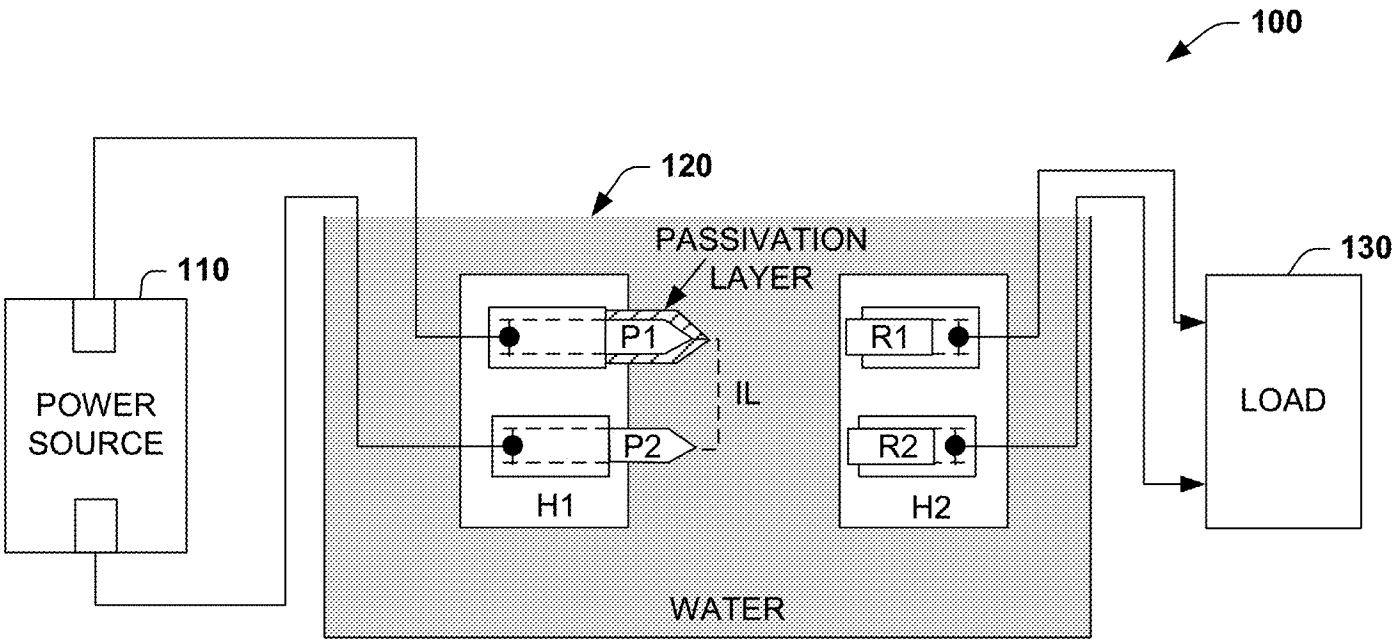
FIG. 1 illustrates an example of a system to enable mating and un-mating of exposed electrical connections in an underwater environment.

FIG. 1 illustrates an example of a system 100 to enable mating and un-mating of exposed electrical connections in an underwater environment. The system 100 includes a first housing (H1) (also referred to as socket interface) that includes a first mating component (P1) formed from a self-passivating transition metal to supply power from a power source 110 (e.g., AC or DC power supply). The self-passivating transition metal has a property of forming a non-conductive passivation layer when immersed in water 120. As used herein, the term component can refer to a mating pin or a mating receptor or any mating surface in a given connector housing or socket interface. A second mating component (P2) formed from the self-passivating transition metal provides a return path for the power 110 and prevents formation of a leakage path for (IL) by forming the non-conductive passivation layer when immersed in the water 120. After the passivation layer has formed, the leakage current IL substantially reduces toward zero current. Although the first and second mating components P1 and P2 are shown as pins (e.g., male type pins) in this example, P1 and/or P2 could be implemented as receptors (e.g., female type sockets) in other examples as illustrated and described below with respect to FIGS. 3A-3C or as plates, for example.

The system 100 includes a second housing connector (H2) that includes at least two mating components shown as receptors R1 and R2 in this example to form a load circuit to a load 130 via the first mating component P1 and the second mating component P2 of the first housing connector H1. As will be illustrated and described below with respect to FIG. 2, a portion of the non-conductive passivation layer of at least one mating component is removed by contact to form a conductive connection when the first housing connector is connected to the second housing connector in the water 120. Although not shown, when immersed in water passivation layers can also form on P2, R1, and R2. If a disconnection occurs between H1 and H2, the passivation layer reforms over P1. The self-passivating transition metal forming pins P1 and P2 and receptors R1 and R2 can include at least one of niobium, tantalum, titanium, zirconium, molybdenum, ruthenium, rhodium, palladium, hafnium, tungsten, rhenium, osmium, and iridium, for example. A communication source (See e.g., FIG. 5) can be provided communicate data across the conductive connection formed when the first housing connector H1 is connected to the second housing connector H2. The communication source can be a radio frequency modulator, for example, that communicates data across the conductive connection via modulation of DC current flowing in the conductive connection.

In one specific example, the system 100 provides a self-insulating underwater electrical connector (SUEC) for alternating current (AC) or direct current (DC) power transfers and data exchanges (e.g., between devices, systems, a pair of electrical conductors, and so forth). The SUEC includes connector pins P1 and P2 and a socket interface configured with mating receptors R1 and R2 for accepting the connector pins. The mating receptors and the connector pins can be fabricated out of self-passivating transition metals such as niobium (Nb) or Tantalum (Ta) metal, for example. Due to the physical properties of the transition metals, a passivation layer can be formed when the transition metals are exposed to water 120. As used herein the term water can include any type of water (e.g., salt water, well water, lake water, river water) that includes enough mineral content to support leakage current flows such as IL described herein. When the mating receptors R1 and R2 and/or the connector pins P1 or P2 interact with water 120, a non-conductive passivation layer forms on a surface of the connector pins and/or the receiving ports by providing insulation from the water.

The connector pins P1 and P2 can be mated with the mating receptors R1 and R2 by positioning (configuring) each connector pin with a respective receptor. The positioning of the connector pins within the mating receptor causes each connector pin to be within physical contact with a physical port. Since the receptor and the connector pin are fabricated out of transition metals, the physical contact causes a disruption in their respective passivation layers to form a low resistance connection. The low resistance connection provides an electrical connection (electrical medium) through which power and/or data can be exchanged. The connector pins P1 and P2 can also be un-mated (disconnected) from the receptor of the SUEC. Disconnecting the connector pin from the receptor exposes the connector pin and the receiving port to the water. This exposure causes the connector pin and the receiving port to re-grow the passivation layer to provide the insulation from the water, and thus, prevent current leakage from the exposed contacts into the water.

Figure 2:
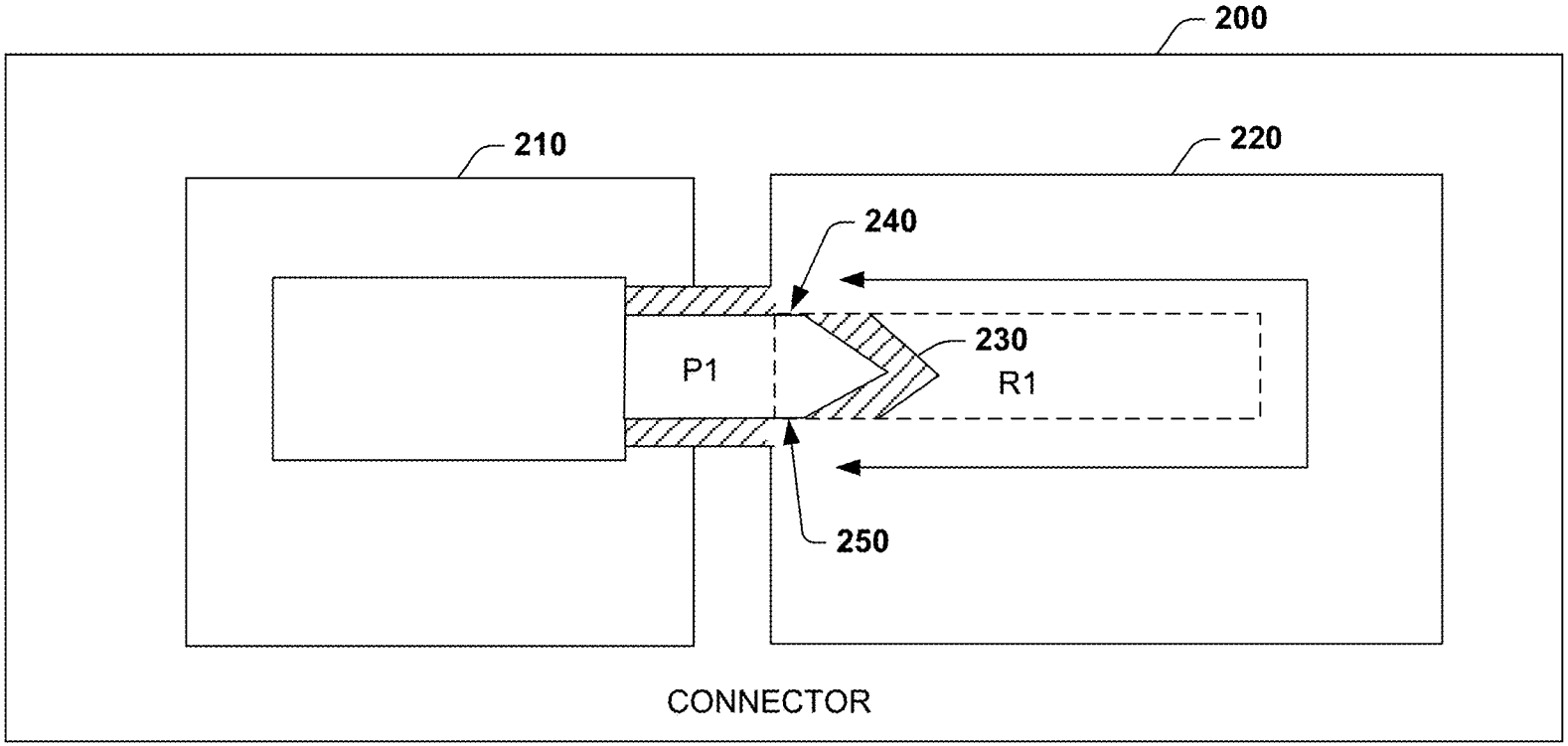
FIG. 2 illustrates an example of forming an electrical contact of exposed electrical connections in an underwater environment.

FIG. 2 illustrates an example of forming an electrical contact of exposed electrical connections in an underwater environment. A connector 200 is formed from a first housing 210 having pin P1 and second housing 220 having receptor R1 shown as a dotted line. As P1 engages R1, portions of a passivation layer 230 are removed or scraped away via contact between pin and receptor. Example contact locations are shown at 240 and 250 where the passivation layer 230 has been removed due to contact. In another example, P1 and R1 can be plates rather than pins that contact each other when the first housing 210 is placed in contact with the second housing 220.

In one specific example, contacts for both the male pins P1 and female receptors R1 can be made out of a transition metal such as niobium metal, for example. Niobium is a transition metal and is in the same group as tantalum in the periodic table, for example. Using oxide growth principles connector 200 grows the passivation layer 230 on its contacts P1 and R1 which provides a durable insulating layer which prevents the flow of electricity through water after contact is made. When a mating contact also made of niobium (or other transition metal) interfaces with the connector 200, it locally disrupts the passivation layer 230 on the pin and receptor and allows for a low resistance connection between the two while still preventing short circuiting through the water to the complementary electrode. The connector 200 effectively "grows" its own insulation in any area of the connector which is exposed to water. Rather than trying to rely on complex seals and oil to exclude water as in a conventional wet-mate connector, the connector 200 utilizes water being in contact with the contacts P1 and R2 to form the insulation.

In one specific example of forming the passivation layer 230, 50VDC (or other potential) can be applied to contacts in the housing 210 and/or 220 before and after immersion in sea water, for example. The contacts can be separated by about 50 mm where all metal surfaces of the contacts exposed to the water are a transition metal such as niobium metal. When power is applied, initial leakage current (IL) through the water with the exposed metal contacts is about 5 mA and rapidly decreases after the passivation layer 230 is formed. If this were a common electrode material such as copper, there would be a short circuit through the water causing rapid corrosion of the metal and generation of hydrogen and chlorine gasses. In this example, a drop of about 180 mV may be measured across both contacts and the wiring to the connectors indicating a resistance of less than 1 ohm through the wiring and contacts. This can be improved by tailoring the contact pressure and pin/socket interface to enhance conductivity when P1 and R1 are mated.

Figure 3A:
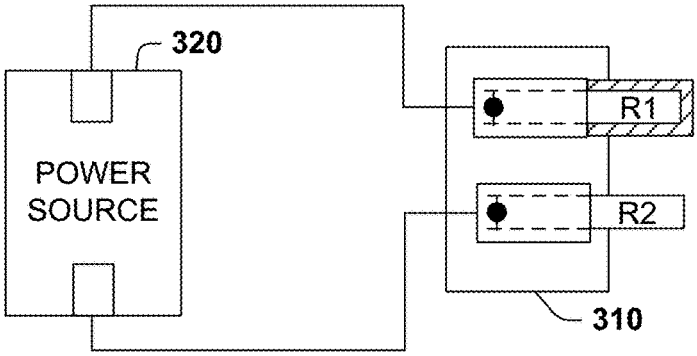
FIGS. 3A-3C illustrates example connector configurations.
Figure 3B:
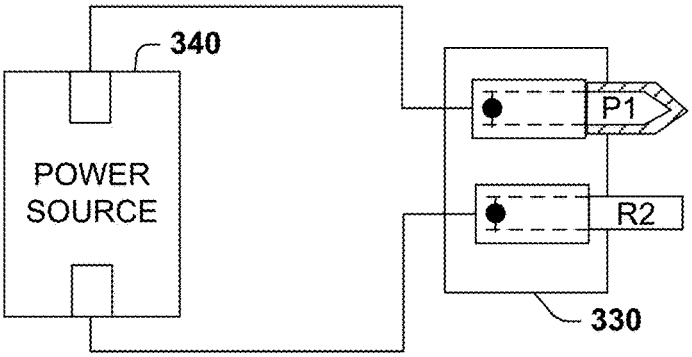
Figure 3C:
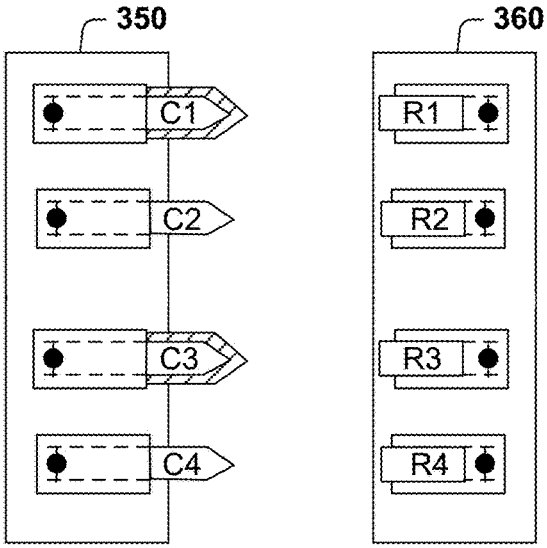

FIGS. 3A-3C illustrate example connector configurations. FIG. 3A illustrates an alternative housing configuration from that depicted in FIG. 1 where a housing 310 includes receptors R1 and R2 that are coupled to power source 320. In FIG. 3B, a housing 330 includes a mixed configuration coupled to power source 340 where at least one component of the housing includes a pin such as P1 and at least one component of the housing includes a receptor such as R2. FIG. 3C illustrates example housings 350 and 360 where additional pins and receptors (e.g., more than two) are provided than are depicted in previous examples.

Figure 4:
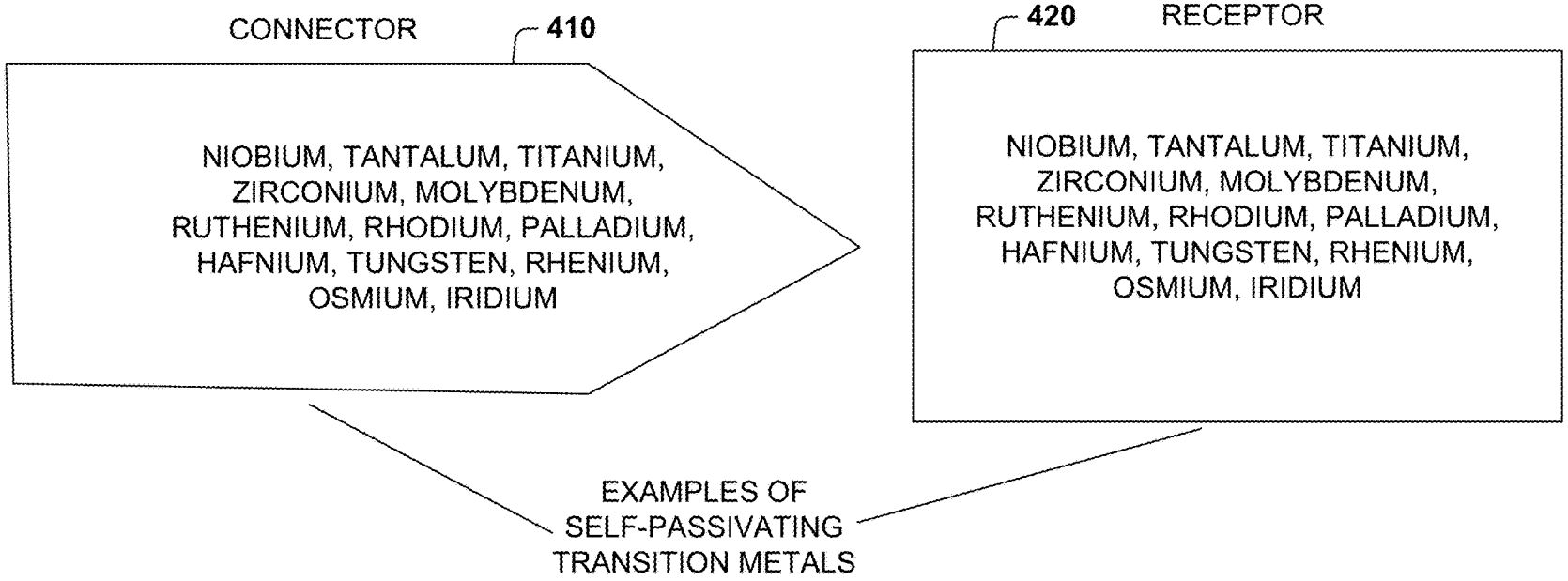
FIG. 4 illustrates examples of self-passivating transition metals that can be utilized for connector pins or receptors.

FIG. 4 illustrates examples of self-passivating transition metals that can be utilized for connector pins or receptors. As shown, a connector pin 410 and connector receptor 420 can include various transition metal examples that provide the capability to form insulating passivation layers when such contacts receive an applied DC voltage in water. As note previously, the self-passivating transition metals can include at least one of niobium, tantalum, titanium, zirconium, molybdenum, ruthenium, rhodium, palladium, hafnium, tungsten, rhenium, osmium, and iridium, for example.

Figure 5:
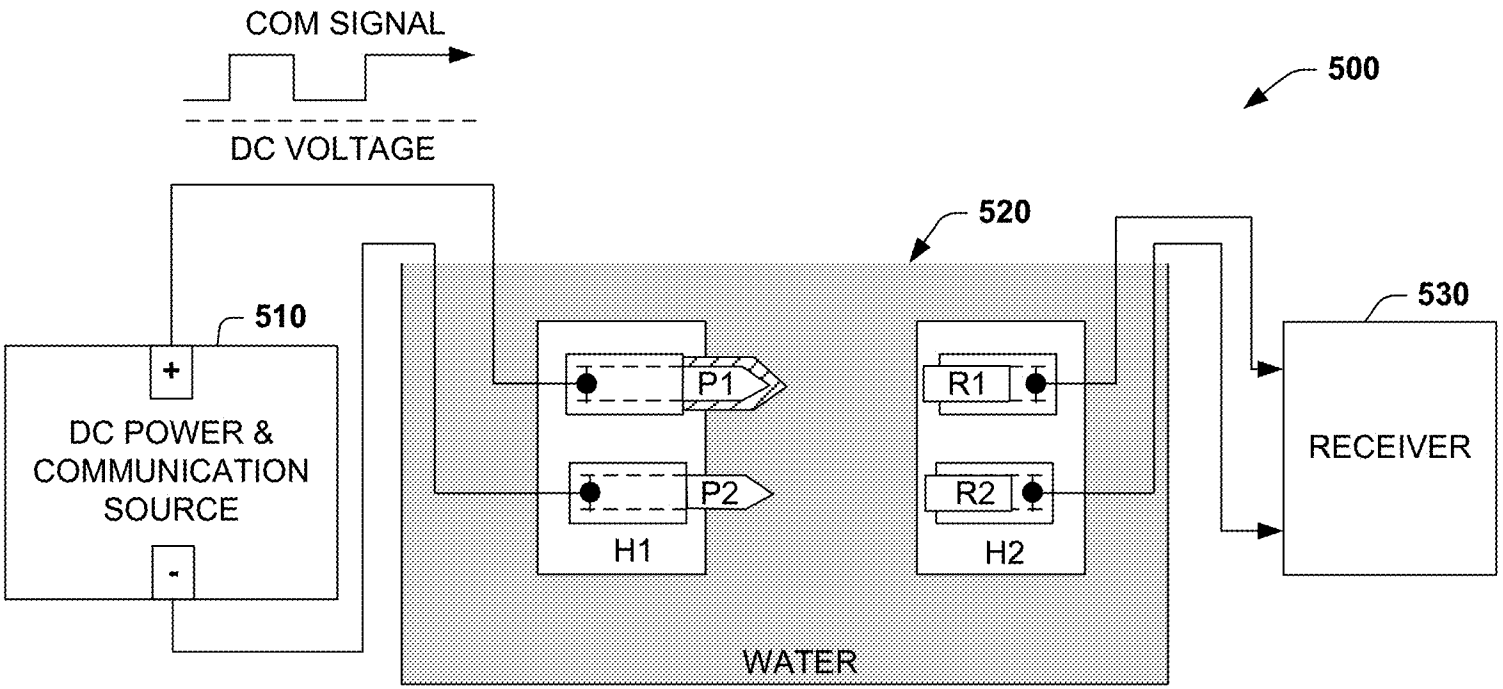
FIG. 5 illustrates an example of system to communicate data via direct current power in an underwater environment.

FIG. 5 illustrates an example of system 500 to communicate data via direct current power in an underwater environment. The system 500 includes a first mating pin 500 formed from a self-passivating transition metal to supply power from power and communications source 510. The self-passivating transition metal has the property of forming a non-conductive passivation layer when immersed in water. A first mating receptor R1 is also formed from the self-passivating transition metal to receive power from the first mating pin P1 in the water 520. A portion of the non-conductive passivation layer is removed by contact to form a conductive connection when the first mating pin P1 is connected to the first mating receptor R1. Pin P2 and receptor R2 are provided in housings H1 and H2 to provide a return path. A communication source can be provided to communicate data across the conductive connection formed by the first mating pin P1 and the first mating receptor R1 to a receiver 530. In one example, the communication source can be integrated with the power source 510 as shown. In an alternative example, the communication source could be integrated within one or both of the housings H1 or H2, for example. The communication source can be a radio frequency modulator, for example, that communicates data across the conductive connection via modulation of direct current (DC) flowing in the conductive connection.

A COM SIGNAL employed for communications is shown riding on top of a DC voltage. Thus, in addition to being able to efficiently transfer power, the system 500 can be used for high speed data transfer by superimposing a low level RF signal on top of the voltage used to provide power to the receiver 530. This can include RF data transfer techniques such as 802.11, for example, that can be used with the system 500. This allows a two contact connector (or more contacts (See e.g., FIGS. 3A-3C) based on the passivation forming capability of the transition metal to provide both power transfer and data transfer. Niobium, for example, can be employed as a transition metal that is readily available, non-toxic, easy to work with and relatively inexpensive. These material properties and its unique electrochemical properties allow manufacturing of reliable and inexpensive wet-mate electrical connectors which can have thousands of mating cycles, for example.

Figure 6:
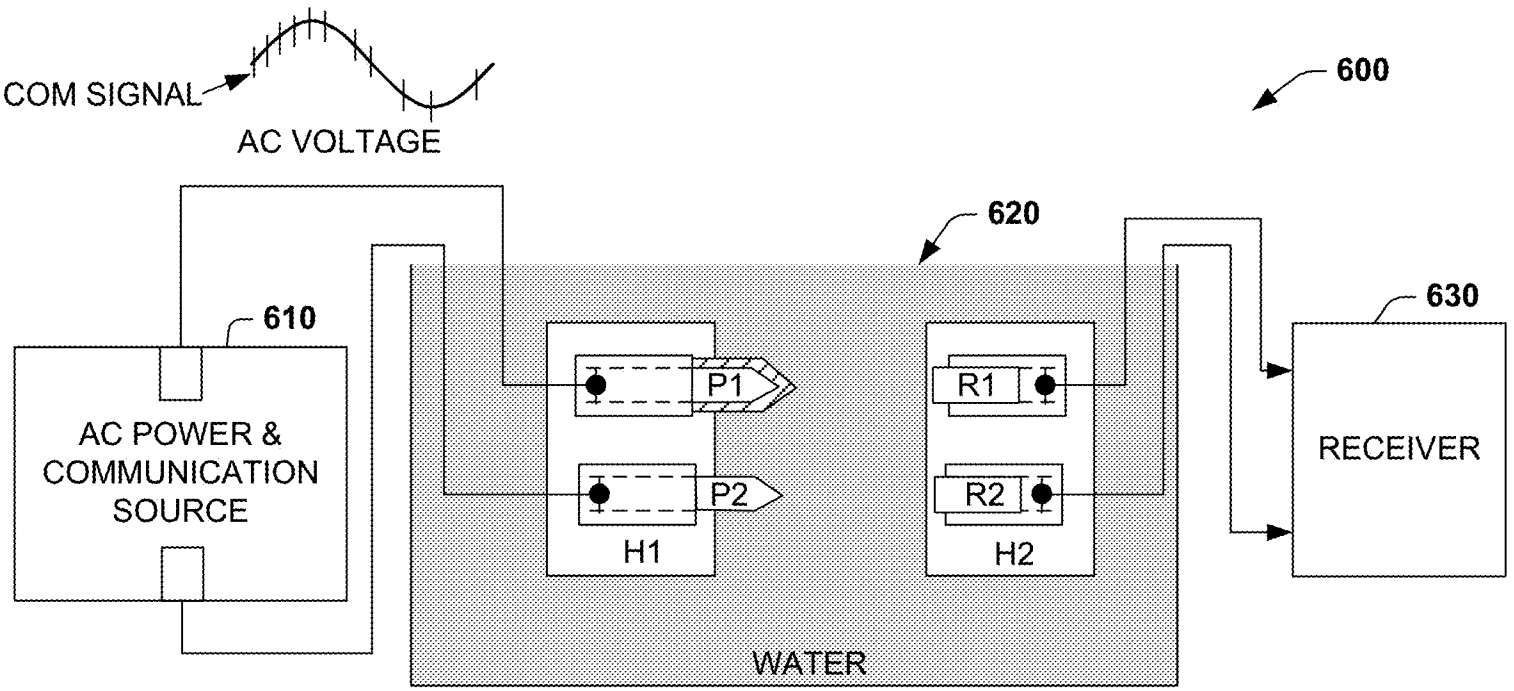
FIG. 6 illustrates an example of system to communicate data via alternating current power in an underwater environment.

FIG. 6 illustrates an example of system to communicate data via alternating current power in an underwater environment. Similar to the system 500 described above, the system 600 includes a first mating pin 600 formed from a self-passivating transition metal to supply power from power and communications source 610. The self-passivating transition metal has the property of forming a non-conductive passivation layer when immersed in water. A first mating receptor R1 is also formed from the self-passivating transition metal to receive power from the first mating pin P1 in the water 620. A portion of the non-conductive passivation layer is removed by contact to form a conductive connection when the first mating pin P1 is connected to the first mating receptor R1. Pin P2 and receptor R2 are provided in housings H1 and H2 to provide a return path. A communication source can be provided to communicate data across the conductive connection formed by the first mating pin P1 and the first mating receptor R1 to a receiver 630. In one example, the communication source can be integrated with the power source 610 as shown. In an alternative example, the communication source could be integrated within one or both of the housings H1 or H2, for example. The communication source can be a radio frequency modulator, for example, that communicates data across the conductive connection via modulation of alternating current (AC) flowing in the conductive connection.

A COM SIGNAL employed for communications is shown riding on top of an AC voltage. Thus, in addition to being able to efficiently transfer power, the system 600 can be used for high speed data transfer by superimposing a low level RF signal on top of the voltage used to provide power to the receiver 630. This can include RF data transfer techniques such as 802.11, for example, that can be used with the system 500. This allows a two contact connector (or more contacts (See e.g., FIGS. 3A-3C) based on the passivation forming capability of the transition metal to provide both power transfer and data transfer.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A system comprising:

a first mating component formed from a self-passivating transition metal to supply power, the self-passivating transition metal having a property of forming a non-conductive passivation layer when immersed in water; and a second mating component formed from a self-passivating transition metal to provide a return path for the power and to form a non-conductive passivation layer when immersed in the water;

wherein a portion of each non-conductive passivation layer is removed due to scraping between the first mating component and the second mating component upon mating thereof to allow power tranfer.

2. The system of claim 1, wherein the self-passivating transition metal is selected from the group comprising niobium, tantalum, titanium, zirconium, molybdenum, ruthenium, rhodium, palladium, hafnium, tungsten, rhenium, osmium, and iridium.

3. The system of claim 1, wherein the first mating component or the second mating component is a pin, a receptor, or a plate.

4. The system of claim 1, wherein the first mating component and the second mating component are housed in a first housing connector.

5. The system of claim 4, further comprising a second housing connector that includes at least two mating components to form a load circuit with the first mating component and the second mating component of the first housing connector.

6. The system of claim 5, further comprising an alternating current (AC) or direct current (DC) power source to provide current upon mating of the first housing connector to the second housing connector.

7. The system of claim 6, further comprising a communication source to communicate data across the conductive connection when the first housing connector is connected to the second housing connector.

8. The system of claim 7, wherein the communication source is a radio frequency modulator that communicates data across the conductive connection via modulation of the current flowing in the conductive connection.

9. A system comprising:

a first mating pin formed from a self-passivating transition metal to supply power, the self-passivating transition metal having a property of forming a non-conductive passivation layer upon immersion in water;

a first mating receptor formed from a self-passivating transition metal to receive the power from the first mating pin in the water, the self-passivating transition metal having a property of forming a non-conductive passivation layer upon immersion in water, wherein a portion of each non-conductive passivation layer is removed due to scraping between the first mating pin and the first mating receptor upon mating thereof; and a communication source to communicate data across a conductive connection formed by mating the first mating pin and the first mating receptor.

10. The system of claim 9, wherein the self-passivating transition metal is selected from the group comprising niobium, tantalum, titanium, zirconium, molybdenum, ruthenium, rhodium, palladium, hafnium, tungsten, rhenium, osmium, and iridium.

11. The system of claim 9, wherein the first mating pin is housed in a first mating connector and a second mating receptor is housed in a second mating connector.

12. The system of claim 11, wherein the first mating connector includes a second mating receptor to provide a return path for the first mating pin.

13. The system of claim 11, wherein the second mating connector includes a second mating pin to provide a return path for the first mating receptor.

14. The system of claim 9, wherein the communication source is a radio frequency modulator that communicates data across the conductive connection via modulation of current flowing in the conductive connection.

15. An underwater system, comprising:

a first mating pin formed from a self-passivating transition metal to supply power, the self-passivating transition metal having a property of forming a non-conductive passivation layer when immersed in water;

a second mating pin formed from a self-passivating transition metal to provide a return path for the power and to form a non-conductive passivation layer when immersed in the water;

a first mating receptor formed from a self-passivating transition metal to receive power from the first mating pin in the water, the self-passivating transition metal having a property of forming a non-conductive passivation layer upon immersion in water, wherein a portion of the non-conductive passivation layer of the first mating pin and the first mating receptor is removed due to scraping between the first mating pin and the first mating receptor upon mating thereof to form a conductive connection; and a second mating receptor formed from a self-passivating transition metal to receive the return path for the power from the second mating pin in the water, the self-passivating transition metal having a property of forming a non-conductive passivation layer upon immersion in water, wherein a portion of the non-conductive passivation layer of the second mating pin and the second mating receptor is removed due to scraping between the second mating pin and the second mating receptor upon mating thereof to form a conductive connection;

wherein the underwater system is configured to expose at least one of the first and second mating pin and the first and second mating receptor to the water while the first mating pin supplies the power, the second mating pin provides a return path for the power, the first mating receptor receives the power, and the second mating receptor receives the return path for the power.

16. The system of claim 15, wherein the self-passivating transition metal is selected from the group comprising niobium, tantalum, titanium, zirconium, molybdenum, ruthenium, rhodium, palladium, hafnium, tungsten, rhenium, osmium, and iridium.

17. The system of claim 15, wherein the first mating pin and second mating pin are housed in a first mating connector and the first mating receptor and the second mating receptor are housed in a second mating connector.

18. The system of claim 15, wherein the conductive connection formed when the first mating pin is connected to the first mating receptor receives an alternating current (AC) or direct current (DC) from a power source.

19. The system of claim 18, wherein the conductive connection receives data via modulation of the current.

* * * * *